United States Patent [19]

Reader et al.

[11] 3,952,228

[45] Apr. 20, 1976

[54] ELECTRON-BOMBARDMENT ION SOURCE INCLUDING ALTERNATING POTENTIAL MEANS FOR CYCLICALLY VARYING THE FOCUSSING OF ION BEAMLETS

[75] Inventors: Paul D. Reader; Harold R. Kaufman, both of Fort Collins, Colo.

[73] Assignee: Ion Tech, Inc., Fort Collins, Colo.

[22] Filed: Nov. 18, 1974

[21] Appl. No.: 524,655

[52] U.S. Cl. ..... 315/111.8; 60/202; 315/169 R; 315/260

[51] Int. Cl.[2] ..... H05H 1/24

[58] Field of Search ..... 315/111.8, 168, 176, 315/169, 246, 260; 60/202; 313/361, 362

[56] References Cited

UNITED STATES PATENTS 3,156,090 11/1964 Kaufman ..... 60/202

3,159,967 12/1964 Petrick ..... 60/202

*Primary Examiner*—Palmer C. Demeo

*Attorney, Agent, or Firm*—Hugh H. Drake

[57] ABSTRACT

An ion source includes apparatus that defines a region in which a supply of ions are produced. An apertured grid is disposed at one end of the region. A potential difference is impressed between the grid and the region so as to accelerate ions out of the region through the grid as a plurality of beamlets, the grid serving to focus those beamlets. To cyclically vary the degree of focus of the beamlets, the system as embodied further includes an arrangement for alternating a potential on the grid relative to a potential elsewhere in the ion source and to which the ions are subjected.

19 Claims, 3 Drawing Figures

ELECTRON-BOMBARDMENT ION SOURCE INCLUDING ALTERNATING POTENTIAL MEANS FOR CYCLICALLY VARYING THE FOCUSSING OF ION BEAMLETS

The present invention pertains generally to electron-bombardment ion sources. More particularly, it relates to an arrangement for reducing ion beam non-uniformity tending to arise by reason of the use of discrete apertures in the overall system for accelerating the ions.

Electron-bombardment ion sources were originally developed as a means for propulsion in outer space. As compared with conventional chemical rockets, the high exhaust velocities available from such ion sources permitted a reduction in propellant mass needed to meet the same propulsion requirements. An earlier version of such an ion source, as developed specifically for space propulsion, is disclosed in U.S. Pat. No. 3,156,090. Various modifications and improvements on such an ion source are disclosed in U.S. Pat. Nos. 3,238,715, 3,262,262 and 3,552,125. Further improvements disclosed in copending application Ser. No. 523,483, filed Nov. 13, 1974, in the name of the same inventors as in this application and assigned to the same assignee as is the present application.

More recently, electron bombardment ion sources have found use in the field of sputter machining. In that field, the ion beam produced by the source is directed against a target, so as to result in the removal of material from the target. This effect is termed sputter erosion. By protecting chosen portions of the target from the oncoming ions, material may be selectively removed from the other portions of the target. That is, these other portions of the target are thereby selectively machined.

Alternatively, essentially the same apparatus can be used for what is called sputter deposition. In this case, a surface to be coated is disposed so as to face the target in order to receive material eroded from the target. Selected portions of the surface under treatment may be masked so that the sputter material is deposited in accordance with a chosen pattern. Moreover, several different target materials may be ionically bombarded simultaneously so as to result in a controlled deposition of alloys of the different materials. In some cases, sputter deposition represents the only way in which the formation and deposit of such alloys may be achieved.

Still another use of the described ion sources is in the implantation or doping of ions into a semiconductor material. Basically, this usage differs from sputter machining only in that higher ion energies are required in order to obtain a useful distance of penetration into the semi-conductor material.

Whatever the specific manner of utilization, such ion sources are especially attractive for sophisticated tasks like those of forming integrated circuit patterns. For example, conductive lines may be deposited on a substrate with thicknesses measured in Angstroms and with widths measuring but tenths or hundredths of a micron. Defects in linearity may be held to less than a few hundredths of a micron.

Electron-bombardment ion sources of the kind under discussion include a chamber into which an ionizable propellant, such as argon, is introduced. Within the chamber is an anode that attracts high-velocity electrons from a cathode. Impigement of the electrons upon the propellant atoms results in ionization of the propellant. At one end of the chamber is an apertured screen followed by an apertured grid. A potential impressed upon the screen accelerates the ions out of the chamber through the apertures in both the screen and the grid, while the apertures in the screen are aligned with those in the grid so as to shield the latter from direct ionic bombardment. The combination of an array of apertures in the screen and the grid together with the application of various potentials to the different conducting elements of the system results in a degree of focusing of the ions as they pass through the respective apertures. Consequently, the resultant ion beam, in actuality, is composed of a plurality of what may be termed individual beamlets. At least usually, another electron-emissive cathode is disposed beyond the grid for the purpose of effecting neutralization of the electric space charge otherwise exhibited by the accelerated ion beam. Preferably, the interior of the chamber is subjected to a magnetic field which causes the electrons emitted from the cathode to gyrate in their travel toward the anode. This greatly increases the chance of an ionizing collision between any given electron and one of the propellant atoms, thus resulting in substantially increased efficiency of ionization.

Such accelerator systems which use multi-apertured screens and grids are capable of producing ion beams that are quite broad in cross-sectional dimensions. As already mentioned, such beams are initially composed of a large plurality of small beamlets. Given sufficient distance, the beamlets eventually overlap and coalesce to produce a single overall ion beam. For use in sputter machining and ion implantation, it is necessary that a high degree of uniformity in current density exists across the width of the ion beam. A non-uniform density would result in uneven material removal or deposition or ion implantation.

Uniformity within the ion beam may be considered from two aspects. The first is the general "profile" shape which arises as a function of the ion production system and the degree of focusing achieved by the accelerator system. The second aspect of ion beam formation involves local variations which exist within the overall profile. Such local variations result from the finite spacing which exists between the apertures and the discrete number of apertures used in the accelerator system screen and grid. It is possible to substantially reduce or even eliminate this kind of local variation by employing highly-divergent beamlets and moving the target to a large distance downstream from the ion source itself. However, this approach has a major drawback in that the ion current density at the target is significantly reduced. Consequently, the exposure time required for a given effect is greatly increased. Moreover, the uniformity of the overall ion beam profile may also suffer when highly divergent beamlets are used in conjunction with placement of the target at a substantial distance On the other hand, the beamlets may be tightly focused so as to have small divergence. In that case, the target may be placed a substantial distance from the ion source without suffering a significant decrease in ion density. At least in some cases, this approach may be desirable, because the use of a large distance between the target and the ion source tends to reduce contamination both of the ion source from materials sputtered back from the target and of the target by extraneous materials sputtered from the ion source. However, the use of tightly focused beamlets results in the retention of local density variations, arising from the use of discrete apertures in the accelerating system, even at long distances down the overall ion beam.

Several known methods exist for reducing such local variations in an ion beam. One effort has been to use the above-mentioned highly divergent beamlets together with a large distance between the ion source and the target, accepting the consequent significant reduction in ion-current density. Another technique has been to use extremely small and closely spaced accelerating system apertures. Unfortuantely, the value of this technique is severely limited by fabrication tolerances and the fragile nature of the resultant accelerator system structure. In a different approach for averaging local variations, relative mechanical motion has been caused to occur as between the ion source and the target. The use of mechanical motion, however, is undesirable, because it involves the employment of items such as motors which must operate in an adverse vacuum environment or the transmission of mechanical motion through sliding or rotating vacuum seals which leads to increased possibility of vacuum leakage.

It is, accordingly, a general object of the present invention to provide a new and improved ion source which exhibits substantial uniformity of the ion beam produced while avoiding the problems and deficiencies adverted to above.

A specific object of the present invention is to provide a new and improved ion source capable of producing a uniform ion beam and in which this is accomplished without having to compromise the structure of the ion source in any manner which would reduce its simplicity in other respects.

A further object of the present invention is to provide a new and improved ion source which achieves a reduction in variations in ion beam density without incurring any substantial reduction in ultimate density at the target and without requiring undue proximity of the target to the ion source itself.

A further specific object of the present invention is to provide a new and improved ion source in which the need for any moving parts is minimized.

In accordance with the present invention, therefore, an ion source includes means for producing a supply of ions within a defined region. An apertured grid is disposed in the vicinity of one end of that region. The source includes means for impressing a potential difference between the grid and the region of the purpose of accelerating ions out of the region through the grid as a plurality of beamlets, the grid serving to focus those beamlets. Finally, the source includes means, including a source of alternating potential, for cyclically varying the degree of focus of the beamlets.

The features of the present invention are set forth with particularity in the appended claims. The invention, together with further objects and advantages thereof, may best be understood by reference to the following description taken in connection with the accompanying drawings, in the several figures of which like reference numerals identify like elements, and in which:

Figure 1:
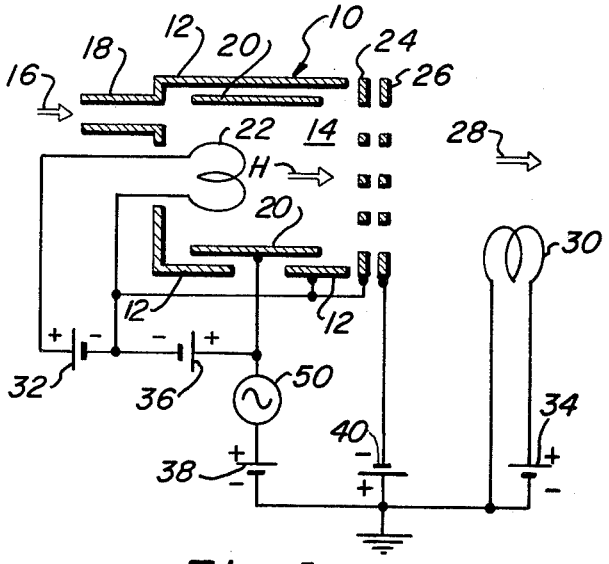
FIG. 1 is a schematic diagram of a first embodiment of an electron-bombardment ion source construced in accordance with the present invention.
Figure 2:
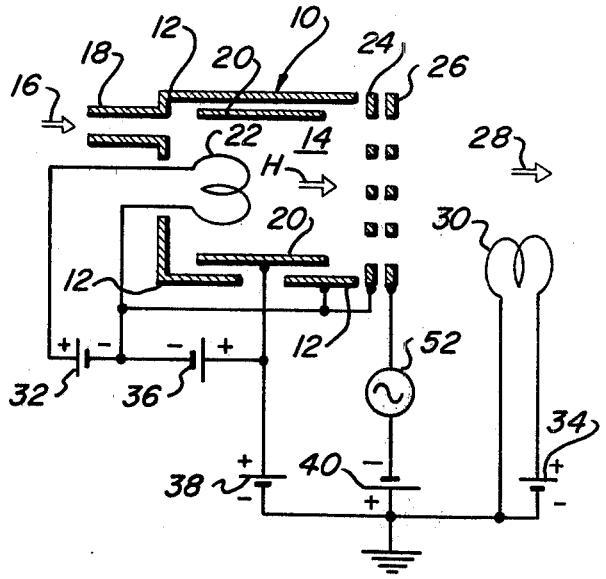
FIG. 2 is a schematic diagram of a first alternative form of such an ion source.
Figure 3:
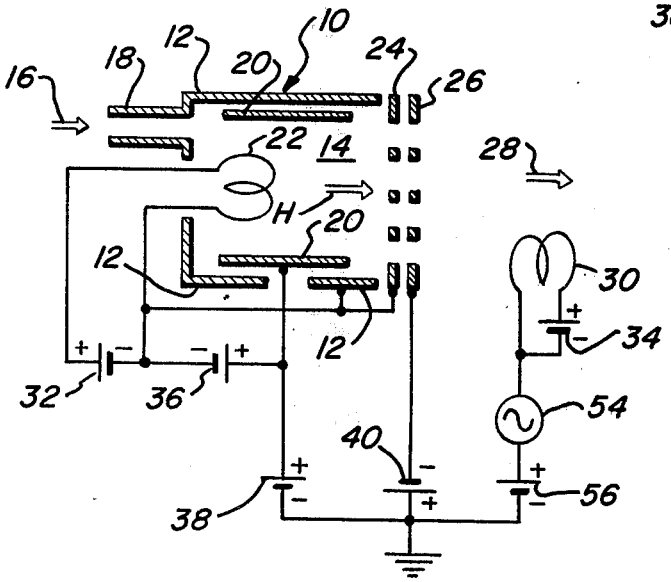
FIG. 3 is a schematic diagram of a second alternative form of such an ion source.

In order perhaps to gain a better understanding of the subject matter, an explanation will first be given with respect to the nature and operation of an electron-bombardment ion source as typically utilized and energized and without inclusion of any of the features of the present invention. It will initially be observed that FIGS. 1, 2 and 3 are set forth in schematic form. While the actual physical structure of the apparatus may, of course, vary, a suitable and workable implementation is that disclosed in the aforesaid U.S. Pat. No. 3,156,090, which patent, therefore, is expressly incorporated herein by reference. Thus, a housing 10 is in the form of a cylindrical metallic shell 12 that circumscribes and defines a chamber 14 in which an ionizable propellant, such as argon, is to be contained. As indicated by the arrow 16, the propellant is introduced into one end of shell 12 through a manifold 18. Disposed symmetrically within shell 12 is a cylindrical anode 20. Centrally positioned within anode 20 is a cathode 22.

In the vicinity of the end shell 12 opposite manifold 18, as herein embodied, is an apertured screen 24. Spaced beyond screen 24 is an apertured grid 26. The apertures in screen 24 are aligned with the apertures in grid 26 so that the solid surfaces of grid 26 shield the solid portions of grid 26 from bombardment of ions that are withdrawn from chamber 14 through screen 24 and grid 26 so as to proceed along a beam path indicated by arrow 28. As mentioned in the introduction, a magnetic field, indicated by arrow H, preferably is established within chamber 14 as by inclusion of a suitable electromagnet or permanent magnet structure surrounding shell 12. The direction of the magnetic lines of force is such as to cause electrons emitted from cathode 22 to gyrate or convolute in their passage toward anode 20. Situated beyond grid 26 and chamber 14 is a neutralization cathode 30.

As herein embodied, cathodes 22 and 30 are each formed of tungsten wire the opposite ends of which are individually connected across respective energizing sources 32 and 34. Sources 32 and 34 may deliver either direct or alternating currents. Other types of cathodes, such as a hollow cathode which, during normal operation, requires no heating current, may be substituted. For creating and sustaining electron emission from cathode 22, a direct-current source 36 is connected at its negative terminal to cathode 22 and at its positive terminal to anode 20. Connected with its positive terminal to anode 20 and its negative terminal returned to system ground, as indicated, is a main power source 38 of direct current. Another direct-current source 40 has its negative terminal connected to accelerator grid 26 and its positive terminal returned to system ground. Finally, one side of neutralizing cathode 30 also is returned to ground. Completing the energization arrangements, both screen 24 and the wall of shell 12 are connected to one side of cathode 22.

In operation, the gaseous propellant introduced through manifold 18 is ionized by high-velocity electrons flowing from cathode 22 toward anode 20. The pressure within chamber 14 is sufficiently low, of the order of $10^{116\ 4}$ Torr, that the emitted electrons tend to proceed to anode 20 with a low probability of creating ionization of the propellant. However, the magnetic field causes the electrons to gyrate so as very substantially to increase the probability of collision between the electrons and the atoms in the propellant. Ions in the plasma which is thus produced are attracted by accelerator grid 26 so as to be directed along path 28.

Screen 24 serves to focus the withdrawn ions into a plurality of beamlets so that they escape through grid 26 without impinging upon its solid portions. The resulting total ion beam traveling on path 28 is then neutralized in electric charge by means of the electrons emitted from neutralizing cathode 30. Power source 36 serves to maintain a discharge current between cathode 22 and anode 20. The energy in the ions which constitutes the ion beam is maintained by power source 38. Power source 40 supplies the negative potential on grid 26 necessary to accelerate the ions out of chamber 14.

While the various potentials involved will vary depending upon the particular propellant utilized, a typical value for the potential of source 36 is between ten and fifty volts. The potential difference exhibited by power source 38 has an exemplary value of five-hundred volts in a sputtering application, one-thousand volts in usage of the ion source for electric space propulsion and 50,000 volts or more for ion implantation. The absolute potential magnitude of accelerating source 40 is generally 0.1 to 1.0 times that of main power source 38. The current through accelerating source 40 is usually only a small fraction of the ion beam current, often of the order of 0.01 or less. Consequently, the ion beam current is substantially equal to the current delivered from main power source 38. For tungsten filaments, cathode heating potentials are typically of the order of 5 to 15 volts. The discharge power involved, the potential from source 36 times the current delivered thereby, generally ranges from about 200 to 1,000 watts per ampere of ions formed in the ultimate ion beam.

For space propulsion, neutralizer 30 is always required. In other applications, such as in sputtering, it may be possible to omit neutralizer 30. For example, with the ion-impinged target connected to the system ground, neutralizer 30 may not be required in cases in which a comparatively low ion beam current is involved.

To initiate the production of ions within chamber 14, a typical prior art approach is to impress a high potential difference between cathode 22 and anode 20. That starting potential may be either a steady direct current or a pulse. Alternatively, or in combination, the applied magnetic field strength may be decreased. In any event, the effective initial high potential difference of such early approaches usually had to be between fifty and one-hundred percent higher than the desired steady state operating potential. A presently preferred alternative approach for the initiation of the production of ions within chamber 14 is disclosed and claimed in the aforementioned copending application. Accordingly, that application is incorporated herein by reference.

Turning now specifically to the features of the present invention, each of the different illustrated embodiments further includes a source of alternating potential that is utilized to cyclically vary the degree of focus of the different beamlets which are accelerated through the apertures in screen 24 and grid 26. As specifically embodied in FIG. 1, an alternating-current power source 50 is coupled in series between power source 38 and the junction between power source 36 and anode 20. Power source 36 is connected between that junction and screen 24, while the negative end of power source 38 is connected to system ground to which power source 40, connected at one end to grid 26, is also returned at its other end. Thus, the action of source 50 is to cyclically vary the potential difference between screen 24 and accelerating grid 26. This applied varying potential difference serves to vary the degree of focusing effected upon the ion beamlets that leave the apertures in accelerator grid 26 and proceed along path 28. Such continuous variation of the beamlet focusing minimizes the time-averaged effects of local variations within the total ion beam traveling along path 28 and which otherwise would result by reason of the existence of the finite apertures in screen 24 and grid 26. Consequently, source 50 serves to enable the maintenance of the ion beam along path 28 at a high current density even at large distances downbeam from the ion source and with the arrangement of the ion source, including screen 24 and 26, being such as to result in a very small value of maximum beamlet divergence.

In a system in which the potential differences supplied by sources 38 and 40 are respectively of 500 and 200 volts, the peak-to-peak value of the alternating potential difference developed by source 50 is desirably of the order of 200 volts in an exemplary system in which the ion source to target distance is equal to or less than the overall ion beam diameter. When larger target distances, of up to two times the overall ion beam diameter are employed, smaller values, of the order of between 60 and 100 volts, are desirably developed by source 50. Smaller values of the alternating potential from source 50 are required in the case of larger target distances, because of the desire to avoid large departures from conditions that should be carefully optimized in order to obtain small beamlet divergence, at least in those cases in which a small decrease in ion beam current density is associated with a large target distance.

In the alternative embodiment of FIG. 2, an alternating-current power source 52 is coupled in series between source 40 and accelerating grid 26. In this case, source 52 serves to vary both the accelerating potential difference between screen 24 and grid 26 and the decelerating potential difference between accelerator grid 26 and neutralizer cathode 30. These potential-difference variations again serve to vary the degree of focusing obtained in the beamlets that leave accelerator grid 26. Such continuous variation in beamlet focusing reduces or eliminates the time-averaged effects of local beam-density variation.

In the still further alternative embodiment of FIG. 3, an alternating current power source 54 is coupled between neutralizer cathode 30 and the system ground. In order to prevent cathode 30 from becoming negative relative to the system ground during any part of the operating cycle of the potential-difference supplied by source 54, an additional direct-current power source 56 is connected in series with alternating-current source 54. The potential difference from source 56 is made to be at least equal to the peak-to-peak value of the alternating potential produced by source 54. Absent the inclusion of source 56, so that cathode 30 could become negative relative to the system ground (which is customarily that to which the entire apparatus surrounding the overall ion beam source is connected), large electron current would flow from cathode 30 to the surrounding apparatus. That, in turn, would place an unduly large load on alternating source 54 during a part of its operating cycle. In the embodiment of FIG. 3, the decelerating potential difference between grid 26 and neutralizer cathode 30 thus varies over a range as determined by the variation in potential difference produced by source 54. That results once more in a variation in beamlet focusing which serves to at least minimize the time-averaged effects of local variations which otherwise would exist within the overall ion beam.

As will now be apparent, the specific implementation of the auxiliary alternating potential-difference source may vary as exemplified by the three different embodiments illustrated. In any case, it amounts to applying an alternating potential on the accelerator grid relative to a potential elsewhere in the ion source and to which the ions are subjected. In one case, the alternating potential is applied to the anode while at the same time being applied indirectly to the cathode and the screen, all of which is referenced to the accelerator grid. In another case, the alternating potential is applied directly to that accelerator grid. In a third alternative, the alternating potential is applied instead directly to the neutralizer cathode. In any case, the degree of focus variation is selected so as to minimize local variations in density of the time-averaged overall ion beam density. At least generally speaking, screen 24 is maintained at a potential substantially the same as that maintained throughout the region defined by chamber 14. When neutralizer cathode 30 is included, it is preferably maintained at a potential intermediate the potentials on grid 26 and those existing within the region defined by chamber 14. In each case, the source of alternating potential is at least effectively applied so as to create a potential variation with respect to a surface within the ion producing region.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. An ion source comprising:

means for producing a supply of ions within a defined region;

an apertured grid disposed in the vicinity of one end of said region;

means for impressing a potential difference between said grid and said region for accelerating ions out of said region through said grid as a plurality of beamlets, said grid serving to focus said beamlets;

and means, including a source of alternating potential, for cyclically varying the degree of focus of said beamlets.

2. An ion source as defined in claim 1 in which said varying means cyclically alters the degree of acceleration effected by said impressing means.

3. An ion source as defined in claim 1 which further includes decelerating means spaced down beam from said region and in which said varying means cyclically alters the degree of deceleration effected by said decelerating means.

4. An ion source as defined in claim 3 in which said varying means also cyclically alters the degree of acceleration affected by said impressing means.

5. An ion source as defined in claim 1 in which said varying means includes means for alternating a potential on said grid relative to a potential elsewhere in said ion source and to which said ions are subjected.

6. An ion source as defined in claim 1 in which an electron-attractive anode is included in said region, and in which said varying means includes a source of alternating potential applied to said anode.

7. An ion source as defined in claim 1 in which said varying means includes a source of alternating potential applied directly to said grid.

8. An ion source as defined in claim 1 and which further includes neutralization means located beyond said grid from said region for neutralizing the electric charge in ions flowing through said grid and in which said varying means includes a source of alternating potential applied to said neutralizing means.

9. An ion source as defined in claim 8 in which said source of alternating potential is coupled so as both to cyclically vary an accelerating potential difference between said grid and an apertured screen, disposed at said one end of said region and said grid, and to cyclically vary a decelerating potential difference between said grid and said neutralization means.

10. An ion source as defined in claim 8 which further includes means for preventing said neutralization means from becoming of a negative potential, as a result of action of said varying means, relative to a point of reference potential for said ion source.

11. An ion source as defined in claim 10 in which said preventing means includes a source of direct-current potential connected in series with said source of alternating potential.

12. An ion source as defined in claim 1 in which the amount of variation in said degree of focus variation is selected to minimize local variations in density of the time-averaged overall ion beam density.

13. An ion source as defined in claim, 1 which further includes an apertured screen disposed at said one end of said region and between said region and said grid, said screen and said grid together serving to focus said beamlets.

14. An ion source as defined in claim 13 in which said source of alternating potential is connected to cyclically vary the potential between said screen and said grid.

15. An ion source as defined in claim 13 in which the apertures in said grid are alined with the apertures in said screen so that said screen shields said grid from ionic bombardment.

16. An ion source as defined in claim 15 in which said screen is maintained at a potential substantially the same as that maintained in said region.

17. An ion source as defined in claim 1 which further includes neutralization means located beyond said grid from said region for neutralizing the electric charge in ions flowing through said grid, and in which said neutralization means is maintained at a potential intermediate the potentials on said grid and existing in said region.

18. An ion source as defined in claim 1 in which said varying means includes a source of alternating potential applied to a surface in said region.

19. An ion source comprising:

means for producing a supply of ions witin a defined region;

an apertured screen disposed at one end of said region;

an apertured grid spaced from said screen in a direction away from said region with the apertures in said grid being alined relative to the apertures in said screen so that said screen shields said grid from ionic bombardment;

means for impressing a potential difference between said grid and said region for accelerating ions out of said region through said screen and said grid as a plurality of beamlets, said screen and said grid together serving to focus said beamlets;

and means, including a source of alternating potential, for cyclically varying the degree of said focus of said beamlets.

* * * * *